US005727399A

United States Patent [19]

Bergagnini

[11] Patent Number: 5,727,399

[45] Date of Patent: Mar. 17, 1998

[54] RING INSERT ASSEMBLY

[75] Inventor: Norberto Bergagnini, Garden City, N.Y.

[73] Assignee: Sandberg & Sikorski Diamond Corporati, New York, N.Y.

[21] Appl. No.: 594,732

[22] Filed: Jan. 31, 1996

[51] Int. Cl.[6] ..... A44C 9/00

[52] U.S. Cl. ..... 63/15.4; 63/15.1

[58] Field of Search ..... 63/15.2, 15.1, 63/15.3, 15.4, 15.8

[56] References Cited

U.S. PATENT DOCUMENTS

| | | | |
|---|---|---|---|
| D. 348,022 | 6/1994 | Sandberg . | |
| 1,178,186 | 4/1916 | Spaney | 63/15.4 |
| 1,333,284 | 3/1920 | Schreiber | 63/15.4 |
| 1,596,642 | 8/1926 | Weber | 63/15.4 |
| 1,800,227 | 4/1931 | Novack | 63/15.4 X |
| 2,117,176 | 5/1938 | Keehnel et al. | 63/15.4 |
| 4,080,803 | 3/1978 | Suzuki | 63/15.4 |
| 4,307,502 | 12/1981 | Scola | 63/15.4 X |
| 5,253,490 | 10/1993 | Doganay | 63/15.4 |
| 5,419,158 | 5/1995 | Sandberg et al. . | |

FOREIGN PATENT DOCUMENTS

| | | | |
|---|---|---|---|
| 2242050 | 9/1973 | France | 63/15.4 |

*Primary Examiner*—Blair Johnson
*Attorney, Agent, or Firm*—Gottlieb, Rackman & Reisman, P.C.

[57] ABSTRACT

A ring insert assembly comprising a pair of rings for accommodating an engagement or other ring therebetween is provided. The ring insert assembly includes a first ring and a second ring spaced from and substantially parallel to the first ring. The rings are interconnected by means of one or more spacing elements or bars such that the space between the two rings of the insert assembly can receive and accommodate a third ring, such as a solitaire, therebetween. One or more hinge assemblies are fixed to the first and second rings, and preferably to the spacing element, for selectively closing off the opening between the rings through which the third ring is inserted.

16 Claims, 2 Drawing Sheets

RING INSERT ASSEMBLY

BACKGROUND OF THE INVENTION

This invention relates to a ring insert assembly, and more particularly, to a ring insert assembly which maintains an engagement or other ring in a captured condition between a ring insert.

Ring inserts are one of the best selling jewelry products. Ring inserts are very popular because of their versatility when paired with a diamond solitaire. Having an insert with a corresponding diamond solitaire or other ring disposed therebetween can create a different, and perhaps more desirable, look than wearing the solitaire alone.

One problem with a ring insert is when storing it along with a complimentary diamond solitaire. When not wearing the ring insert with the solitaire on one's finger, the solitaire can be easily separated from between the two bands of the ring insert.

Accordingly, it would be desirable to overcome this disadvantage and to construct a ring insert assembly which maintains a diamond solitaire therebetween in a captured condition, whether the insert is being worn or not.

SUMMARY OF THE INVENTION

Generally speaking, in accordance with the invention, a ring insert assembly comprising a pair of rings for accommodating an engagement or other ring therebetween is provided. The ring insert assembly includes a first ring having a first band and a second ring having a second band spaced from and substantially parallel to the first ring. The rings are interconnected by means of one or more spacing elements or bars such that the space between the two rings of the insert assembly can receive and accommodate a third ring, such as a solitaire, therebetween.

The ring insert assembly of the invention further includes means for selectively closing off at least a portion of the opening defined by the insert through which the third ring is inserted for disposition in parallel alignment with the two rings of the insert assembly. By being able to selectively close off at least a portion of this opening, the third ring is prevented from being separated or removed from its position between the two rings of the insert assembly.

Preferably, the ring insert assembly includes at least one or two hinge or arm assemblies depending from the first and second rings, and preferably from the spacer elements. Each hinge assembly is pivotally connected to the spacer element and includes an extending arm which can be selectively and pivotally moved to overlie at least a portion of the opening between the first and second rings. As a result, after the third ring is inserted between the first and second rings of the insert assembly, the hinge assemblies are operated in order to close off at least a portion of the insert opening so that the third ring cannot be removed or otherwise separated therefrom.

In other words, the ring insert assembly of the invention is advantageous since the solitaire, if desired, cannot be separated from the ring insert, even when the insert is not being worn on the wearer's finger. Of course, the solitaire ring will always be maintained in proper position between the two rings of the insert, ensuring the aesthetic appeal of the overall assembly.

Optionally, the arms of the hinge assembly can include one or more stones or other jewelry ornaments which would compliment the solitaire that is inserted between the rings of the insert assembly.

Accordingly, it is an object of the invention to provide an improved ring insert assembly.

Still another object of the invention is to provide a ring insert assembly which maintains an engagement or other ring in a captured condition therewithin.

Yet a further object of the invention is to provide a ring insert assembly which prevents the ring inserted within the insert from being removed or otherwise separated therefrom.

Still other objects and advantages of the invention will in part be obvious and will in part be apparent from the following description.

The invention accordingly comprises the assembly having the features, properties and relation of components which will be exemplified in the assembly hereinafter described, and the scope of the invention will be indicated in the claims.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENTS

Figure 1:
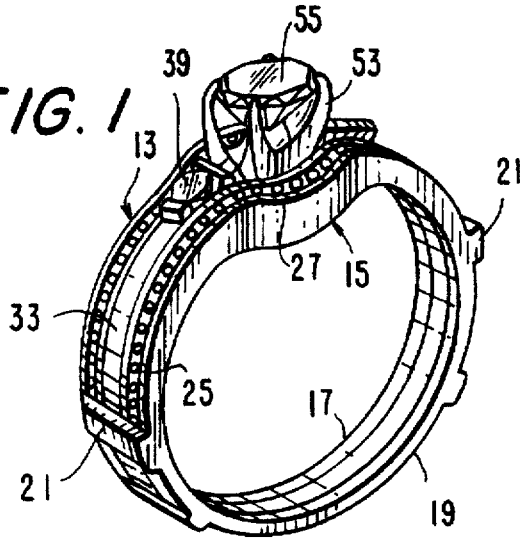
FIG. 1 is a perspective view of the ring insert assembly of the invention in a closed condition, with an engagement ring disposed between the two bands of the insert assembly.
Figure 2:
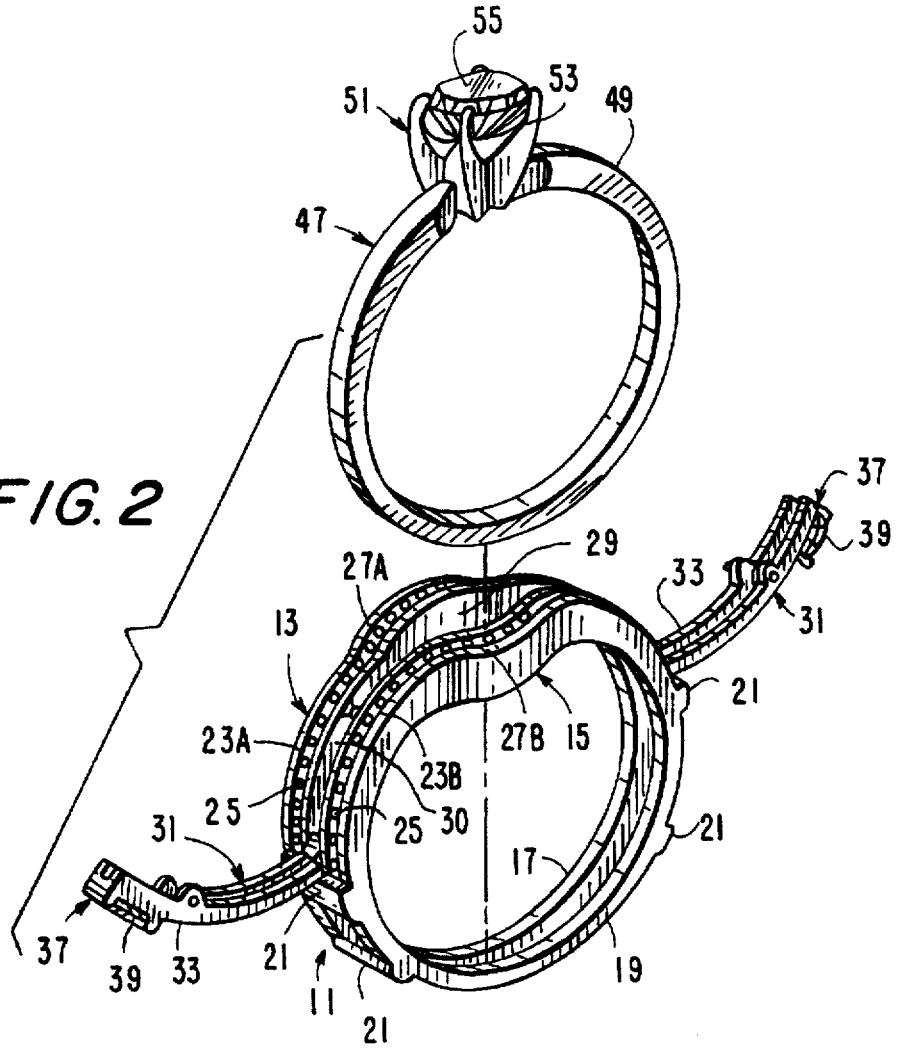
FIG. 2 is an exploded perspective view of the ring insert as well as the engagement ring therefor that is disposed between the two bands of the insert.

Referring first to FIGS. 1 and 2, a ring insert assembly made in accordance with the invention and generally indicated at 11 is described. Ring insert assembly 11 comprises a first ring 13 and a second ring 15 spaced substantially parallel from and in an aligned relationship with first ring 13. Ring 13 includes a band 17 in which an extending channel 23A is formed along at least a portion of the outer wall of the band, as shown in FIG. 2. Similarly, ring 15 includes a band 19 having an extending channel 23B formed at least partially along its outer wall. Each of channels 23A and 23B retain a plurality of stones 25 in series. Each of stones 25 seated in channels 23A and 23B of bands 17 and 19 respectively is mounted in a corresponding hole (not shown) located underneath each channel. Stones 25 retained in channels 23A and 23B provide a pleasing aesthetic appearance.

As shown in FIGS. 1 and 2, each of bands 15 and 17 have a width which is substantially the same all around, even where channels 23A and 23B run therealong. Bands 17 and 19 are each designed with a substantially curved deformation, 27A and 27B respectively, in the axial direction with respect to rings 13 and 15. Each of deformations 27A and 27B of bands 17 and 19 respectively are located along at least a portion of the bands in which channels 23A and 23B run therealong. As can be appreciated, curved deformations 27A and 27B project in opposite directions and extend outwardly on either side of the insert assembly, as shown in FIG. 2. Curved deformations 27A and 27B define an opening between bands 17 and 19 for selectively accommodating a mounting 51 of a third ring 47 between the deformations, as shown in FIG. 1 and described in more detail later on.

Figure 3:
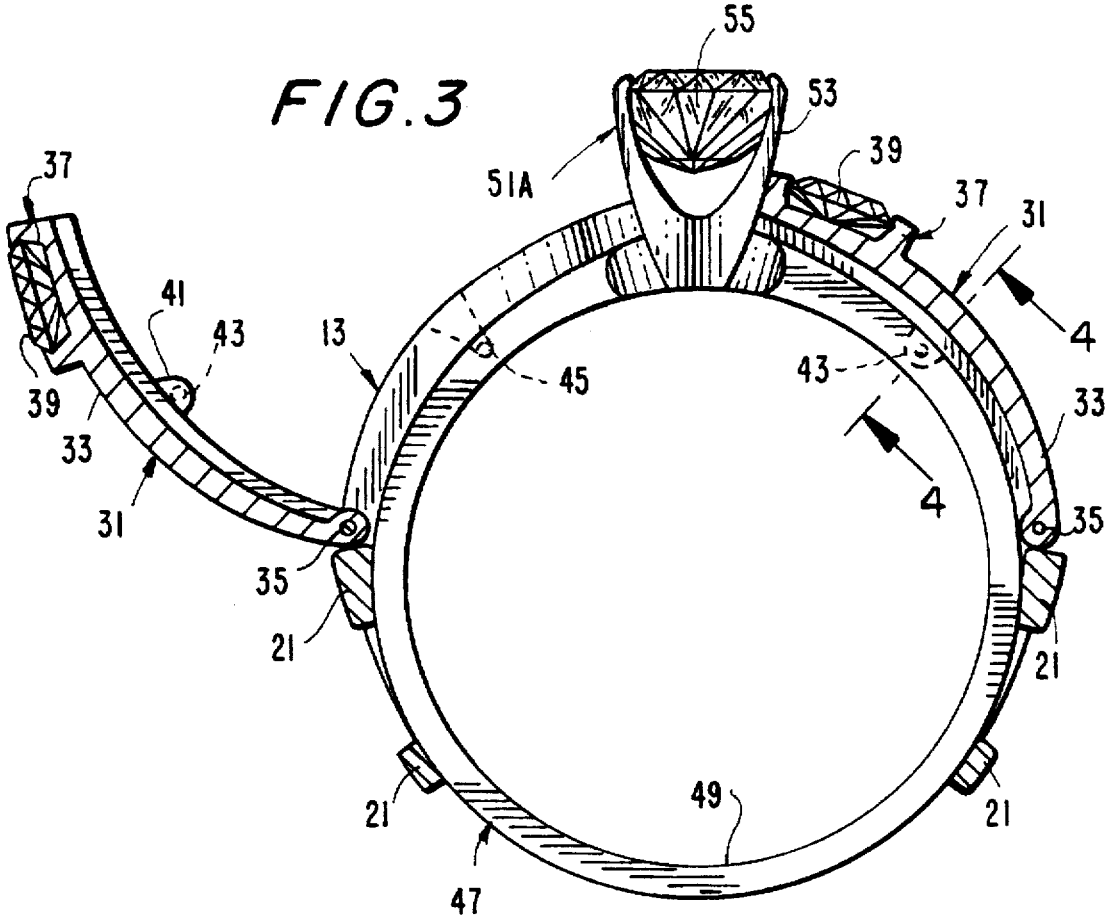
FIG. 3 is a front elevational view of the insert assembly of the invention and showing the assembly with one hinge member in a closed condition, and a second hinge member in an open condition.
Figure 4:
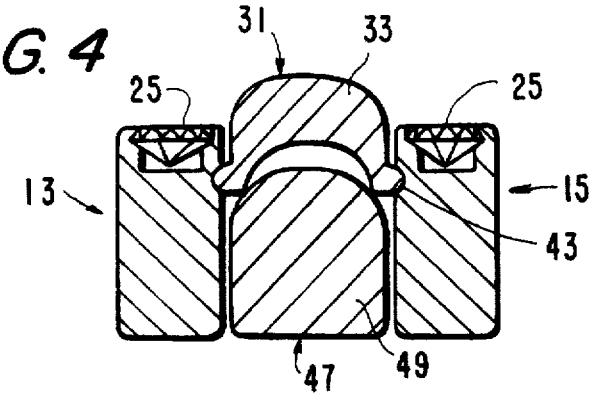
FIG. 4 is a cross-sectional view taken along line 4—4 of FIG. 3.

Referring now to FIGS. 1 and 2, as well as to FIG. 3, rings 13 and 15 are interconnected by means of a series of spacing members or crossbars 21. One end of each of crossbars 21 is fixed to ring 13, while the other end is fixed to ring 15. In the embodiment as shown, two pairs of spacing members or crossbars 21 are provided, the pairs radially spaced from each other such that an extending opening 30 running at least 180° is provided between bands 17 and 19. A third ring can be inserted through opening 30 and between rings 13 and 15 of insert assembly 11, as shown in FIG. 1.

Turning now to FIGS. 2 and 3, insert assembly 11 further includes a pair of hinge elements 31, each of which is pivotally connected or fixed to the top-most located spacing member 21 of each spacing member pair.

Each hinge element 31 comprises a moveable arm 33 and a pivot pin 35 which enables the arm 33 to pivotally rotate, as can be appreciated from looking at FIGS. 2 and 3. Each hinge element further includes a setting 37 located at the remote end of arm 33 for accommodating therewithin a stone or gem 39. Stone or gem 39, as will be understood, is configured and selected to aesthetically compliment the stone of the solitaire to be inserted.

Turning once again to FIGS. 1 and 2, a ring 47, such as an engagement ring, is suitable for being mounted or inserted through opening 30 and between rings 13 and 15 of insert assembly 11, as shown in FIG. 1. Ring 47 comprises a band 49 and a mounting 51 fixed thereon. Mounting 51 includes a multi-prong setting 53, as is well known in the art, for retaining a stone 55, such as a solitaire or some other type of diamond, therewithin.

In the first instance, ring 47 is inserted through opening 30 and between rings 13 and 15 of assembly 11, as shown in FIGS. 1 and 3. Band 49 of ring 47 is now substantially aligned with bands 17 and 19 of rings 13 and 15, respectively. Once ring 47 is appropriately positioned between rings 13 and 15 of insert assembly 11, hinge elements 31 may be selectively operated to close off respective portions of extending opening 30 by pivotally rotating arms 33 to a closed condition (see FIG. 1). Of course, when in a closed condition, hinge elements 31 are sized to not extend into space 29 located between bands 17 and 19 of rings 13 and 15 respectively, and through which mounting 51 of ring 47 selectively projects.

Each of hinge elements 31 is further provided with a pair of projections 41 on which buttons 43 outwardly extend. Buttons 43 are sized for capture within notches 45 located appropriately along the inside walls of each of bands 17 and 19 of rings 13 and 15, respectively. Thus, when in a closed condition, each of hinge elements 31 is fixedly retained along a portion of opening 30, and between bands 17 and 19.

If it is later desired to remove ring 47 from insert assembly 11, hinge elements 31 are operated such that arm 33 is rotatably pivoted in an opposite direction, once again exposing all of opening 29. Then, ring 47 may be removed therefrom.

It will thus be seen that the objects set forth above, among those made apparent in the preceding description, are efficiently attained, and since certain changes may be made in the described assembly and in its construction, without departing from the spirit and scope of the invention, it is intended that all matter contained in the above description and shown in the drawings shall be interpreted as illustrative and not in a limiting sense.

It is also to be understood that the following claims are intended to cover all of the generic and specific features of the invention herein described and all statements of the scope of the invention which, as a matter of language, may be said to fall therebetween.

I claim:

1. A ring insert assembly comprising:

a first ring with a circumference and a second ring with a circumference such that the rings are spaced apart over a major portion of said circumferences, said rings defining planes substantially parallel to each other;

means for fixedly spacing said rings in order to selectively insert a third ring through a radially extending opening defined between the first and second rings such that said third ring can be disposed between and in substantial alignment with the first and second rings;

at least one arm member pivotally rotatable in a plane substantially parallel to said ring planes in order to rotatably move from an open condition away from said first and second rings of said insert assembly to a closed condition for selectively closing off at least a portion of said radial opening.

2. The assembly of claim 1, wherein said spacing means comprises at least one traversing bar extending between said first and second rings from which said at least one arm member pivotally and rotatably depends.

3. The assembly of claim 2, wherein said spacing means further comprises a pair of traversing bars from each of which an arm member pivotally and rotatably depends.

4. The assembly of claim 3, wherein said arm members define a space therebetween when in a closed condition through which a mounting of said third ring extends when said third ring is disposed between said first and second rings of said insert.

5. The assembly of claim 1, wherein said at least one arm member comprises at least one setting for accommodating at least one jewelry stone display.

6. The assembly of claim 1, further comprising means for selectively engaging said at least one arm member with said at least one of said first or second rings of said insert when closing off said at least a portion of said radial opening.

7. The assembly of claim 1, wherein each of said first and second rings comprises one or more jewelry stones running therealong.

8. The assembly of claim 7, wherein said at least one arm member includes one or more jewelry stones complimentary to said one or more jewelry stones running along said first and second rings.

9. A ring assembly comprising:

a ring insert comprising a first ring including a first band and a second ring including a second band, said bands of said rings disposed in substantially parallel relationship to each other and fixedly spaced from each other for defining a radial opening running along and between said bands from a first radial location to a second radial location thereof;

a third ring including a third band and a mounting sitting thereon selectively insertable in and removable from between said first and second rings of said ring insert through said radial opening defined by said first and second bands, so that said third band of said third ring can be positioned in aligned condition with said first and second bands of said first and second rings; and means for selectively closing off a major portion of said radial opening for preventing removal of said third ring from between said first and second rings;

said closing off means defining a space between said first and second bands when said portion of said radial opening is closed off, said space sized for accommodating therethrough said mounting of said third ring when said third ring is alignigly disposed between said first and second rings of said insert, said space further sized in order to preclude said third ring from slipping out from between said first and second rings.

10. The assembly of claim 9, wherein said closing off means comprises at least one arm member pivotally rotatable from an open condition away from said first and second rings of said insert to a closed condition for selectively closing off said at least a portion of said radial opening.

11. The assembly of claim 10, further comprising at least one traversing bar extending between and fixedly spacing said first and second rings 42 from which said at least one arm member pivotally and rotatably depends.

12. The assembly of claim 11, wherein said at least one traversing bar comprises a pair of traversing bars from each of which an arm member pivotally and rotatably depends.

13. The assembly of claim 10, wherein said at least one arm member comprises at least one setting for accommodating at least one jewelry stone display.

14. The assembly of claim 10, further comprising means for selectively engaging said at least one arm member with said at least one of said rings of said insert when closing off said at least a portion of said radial opening.

15. The assembly of claim 10, wherein each of said first and second rings comprises one or more jewelry stones running therealong.

16. The assembly of claim 15, wherein said at least one arm member includes one or more jewelry stones complimentary to said one or more jewelry stones running along said first and second rings.

* * * * *